United States Patent [19]

Ogawa

[11] 4,227,059

[45] Oct. 7, 1980

[54] DRIVING MECHANISMS FOR VACUUM CIRCUIT BREAKERS

[75] Inventor: Seishi Ogawa, Yokohama, Japan

[73] Assignee: Tokyo Shibaura Denki Kabushiki Kaisha, Kanagawa, Japan

[21] Appl. No.: 48,233

[22] Filed: Jun. 13, 1979

[30] Foreign Application Priority Data

Jun. 19, 1978 [JP] Japan ..... 53-73910

[51] Int. Cl.[2] ..... H01H 3/00; H01H 35/24; H01H 1/50

[52] U.S. Cl. ..... 200/153 G; 200/81 R; 200/337; 200/251; 92/13.51; 92/13.7

[58] Field of Search ..... 200/249, 251, 287, 337, 200/81, 153 G; 92/13, 13.51, 13.7

[56] References Cited

U.S. PATENT DOCUMENTS

| | | | |
|---|---|---|---|
| 2,548,807 | 4/1951 | Morgan et al. | 92/13.7 X |
| 2,898,867 | 8/1959 | Saalfrank | 92/13.7 X |
| 4,146,766 | 3/1979 | Forrester et al. | 200/337 X |

FOREIGN PATENT DOCUMENTS 47-47947 12/1972 Japan .

OTHER PUBLICATIONS

Journal of Fuji Elec. Co., Ltd., vol. 51, No. 9, pp. 26–31, 1978.

General Elec. Co., GEA-8183C, 9/73.

*Primary Examiner*—Steven M. Pollard

*Attorney, Agent, or Firm*—Stevens, Davis, Miller & Mosher

[57] ABSTRACT

In a driving mechanism for a vacuum circuit breaker including a movable contact, a stationary contact and bellows permitting reciprocating movement of the movable contact, a bell crank is oscillated by an actuating device to reciprocate a drive bar connected to the movable contact. As the movable and the stationary contacts are worn, the displacement of the drive is increased. The increase is detected and the pivot point of the bell crank is shifted toward the stationary contact. Thus retracted position of the movable contact is shifted in accordance with the wear, and the stroke of the movable contact and hence the amplitude of variation in length of the bellows are maintained constant in spite of the wear.

12 Claims, 4 Drawing Figures

DRIVING MECHANISMS FOR VACUUM CIRCUIT BREAKERS

BACKGROUND OF THE INVENTION

The present invention relates to a driving mechanism for a vacuum circuit breaker, and more particularly to a driving mechanism of a vacuum circuit breaker which is frequently operated such as that used in an on-load tap changer.

As is well known, a vacuum circuit breaker is provided with bellows for permitting linear reciprocating motion of the movable contact rod while maintaining a hermetic seal. Conventional driving mechanisms drive the movable contact rod at predetermined velocities for opening and closing the circuit breaker.

However, through repeated interruptions of current, the movable and the stationary contacts of the breaker are consumed and worn out due to arcs across the contacts. For instance, a vacuum circuit breaker for an on-load tap changer is required to withstand several millions of repeated interruptions before the total wear of the movable and stationary contacts becomes about 2 mm when the vacuum circuit breaker has to be replaced. As the movable and the stationary contacts are worn out, the movable contact has to be advanced further in order to engage with the stationary contact. The position at which the movable contact rests (the retracted position of the movable contact) remains fixed. As a result, the travel or stroke of the movable contact is increased, and accordingly the amplitude of variation in length of the bellows is increased. With increased amplitude, the fatigue of the bellows in accelerated.

FIG. 1 shows a relation between the total wear $\delta$ of the movable and the stationary contacts and the distance S from the retracted position of the movable contact and the advanced position at which the movable contact engages with the stationary contact. In a conventional mechanism where the retracted position is fixed, the distance S coincides with the travel or the stroke of the movable contact and hence with the amplitude of variation in the length of the bellows. The initial stroke $S_1$ (when the contacts are not yet worn) is determined according to the voltage across the contacts and the required interrupting capacity.

As openings and closings of the vacuum circuit breaker are repeated, wear of the contact is gradually increased and the stroke S of the movable contact is increased as depicted by dashed line S. When the wear becomes $\delta_2$, the stroke $S_2$ of the bellows is given by:

$$S_2 = S_1 + \delta_2$$

Accordingly, the amplitude of variation in length of the bellows is increased, the fatigue of the bellows is accelerated and the service life of the bellows is shortened.

SUMMARY OF THE INVENTION

An object of the invention is to provide a driving mechanism for a vacuum circuit breaker which prolongs the service life of the bellows.

A more particular object of the invention is to provide a driving mechanism for a vacuum circuit breaker in which the amplitude of variation in length of the bellows is automatically maintained constant against the wear of the contacts.

According to the invention, there is provided a driving mechanism for a vacuum circuit breaker of the type wherein a movable contact is moved toward and away from a stationary contact, the driving mechanism having an actuating device for opening and closing the vacuum circuit breaker, and a bell crank rotatable about a pivot pin and interposed between the actuating device and the movable contact, characterized by further comprising a shifting member for shifting, in accordance with the wear of the movable and the stationary contacts, the pivot pin of said bell crank in parallel with the axis of the movable contact to correct retracted position of the movable contact, to compensate for the wear of the movable and the stationary contacts.

DESCRIPTION OF THE PREFERRED EMBODIMENTS

Figure 2:
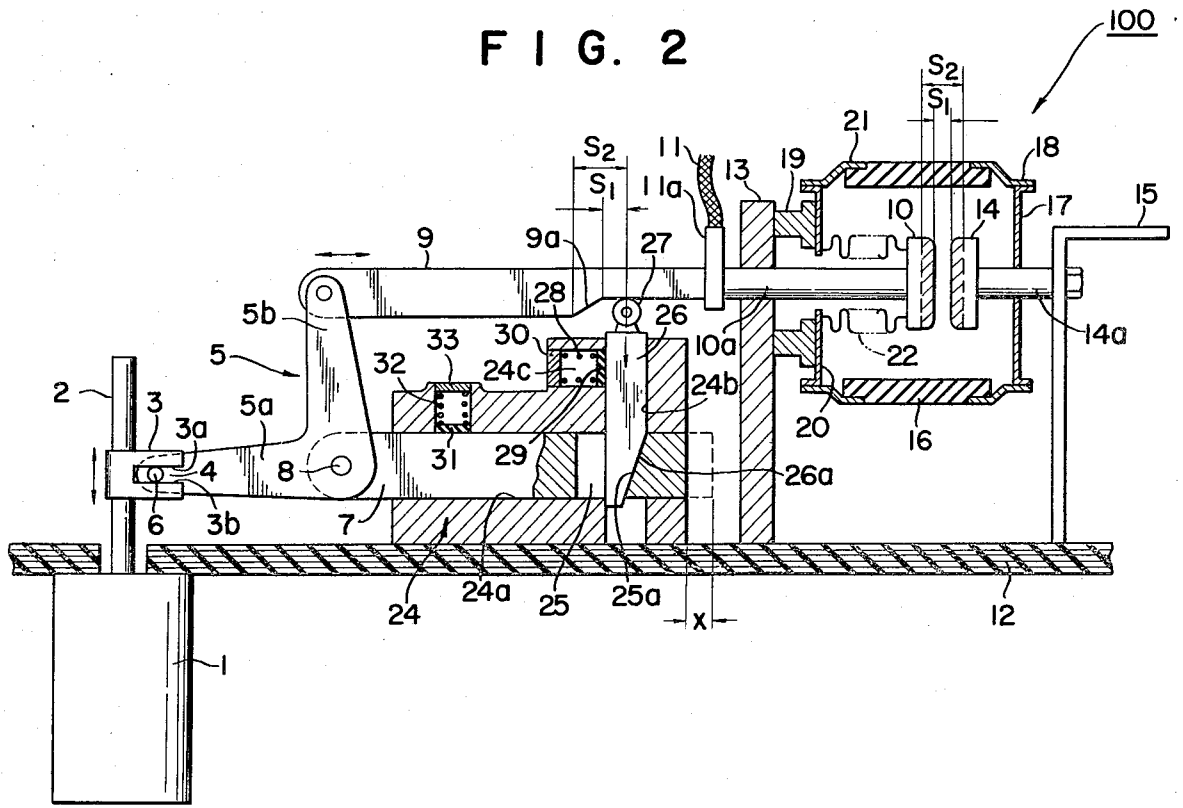
FIG. 2 is a side view, partly in section, showing an embodiment of a driving mechanism according to the invention.

In FIG. 2, there is shown a vacuum circuit breaker generally indicated by numeral 100. An actuating member 1 is provided for opening and closing the vacuum circuit breaker 100. The actuating member 1 is provided with an output rod 2 which extends substantially vertically (as viewed in FIG. 2). The actuating member 1 may comprise any device for causing upward and downward movements of the output rod 2. For instance, the actuating member 1 may comprise a spring which is adapted to be resiliently compressed and released in a direction parallel to the output rod 2, an electric motor, a mechanism for converting rotation of the electric motor into upward movement of the output rod 2, and a device for compressing the spring as the electric motor is reversely rotated and releasing the spring (for instance by disengaging a ratchet wheel), as the compression thereof exceeds a predetermined limit, whereby as the spring is released it pulls down the output rod 2.

The housing of the actuating member 1 is fixed to a laminated insulator board 12 forming part of the stationary structure.

The output rod 2 is provided with a lateral projection 3, which is provided with a slot 4 defined by a pair of opposite inner edges 3*a* and 3*b* to extend in a direction normal to the axis of the output rod 2.

A bell crank 5 is provided, having its bent portion pivotally mounted by a pivot pin 8 (constituting the pivot point of the bell crank) to a shifting bar 7, which will be described later. Secured to the end of a first arm 5*a* of the bell crank 5 is a pin 6 which extends through the slot 4 and which is in slidable engagement with the inner edges 3*a* and 3*b*. The end of a second arm 5*b* of the bell crank 5 is pivotally coupled to a first end of movable bar 9 which extends substantially horizontally (as viewed in FIG. 2). A second end of the movable bar 9 is connected to a first end of a movable rod 10*a* which also extends substantially horizontally. A movable contact 10 is attached to a second end of the movable rod 10*a*. A flexible conductor 11 is electrically connected to the movable rod 10*a* by means of a terminal 11*a* to enable conduction of electric current to the movable contact 10. The movable rod 10*a* is slidably supported by a supporting member 13, which is secured to the insulator board 12.

Disposed in confrontation with the movable contact 10 is a stationary contact 14 attached to a first end of a stationary rod 14*a* which extends substantially horizontally. The stationary rod 14*a* is supported by a connecting plate 15, enabling electrical connection of the stationary contact 14 to an external circuit. The connecting plate 15 is fixed to the insulator board 12.

An insulator cylinder 16 is disposed concentric with the movable and stationary rods 10*a* and 14*a* to surround the movable and stationary contacts 10 and 14. One end (the right end, as viewed in FIG. 2) of the insulator cylinder 16 is secured to an insulator cylinder holder 18, which in turn is attached to the outer periphery of an annular end plate 17, whose inner periphery is mounted to the stationary rod 14*a*. The other end of the insulator cylinder 16 is secured to another insulator cylinder holder 21, which is attached to the outer periphery of another end plate 20, whose inner periphery defines an opening through which the movable rod 10*a* extends. The annular end plate 20 is fixed by a spacer tube 19 to the supporting member 13. Generally cylindrical bellows 22 is provided, having a first end thereof connected to the inner periphery of the annular end plate 20 and a second end connected to the rear side of the movable contact 10, to surround part of the movable rod 10*a*. Thus, the bellows 22 permits reciprocating movement of the movable contact 10 for opening and closing, while establishing hermetic seal to form a vacuum chamber in which the movable and stationary contacts 10 and 14 are enclosed. The pressure in the vacuum chamber is maintained at a pressure of $10^{-6}$ Torr or lower to facilitate interruption of electric current.

As the output rod 2 is reciprocated, the bell crank 5 is oscillated and the movable bar 9, and hence the movable rod 10*a* and the movable contact 10 are reciprocated for opening and closing the circuit.

A bearing block 24 is fixed to the insulator board 12. The bearing block 24 is provided with a substantially horizontally extending bore 24*a*, through which the shifting bar 7 slidably extends. The shifting bar 7 is provided with a vertical, elongated perforation 25 elongated along the axis of the shifting bar 7. The bearing block 24 is also provided with a substantially vertical bore 24*b*, which is in alignment with the elongated perforation 25. A detection rod 26 extends through the bore 24*b* and the elongated perforation 25, and is slidably supported by the bearing block 24. The detection rod 26 has an inclined surface 26*a* inclined relative to its axis. The rightward extremity of the elongated perforation 25 of the shifting bar 7 is defined by an inclined surface 25*a*, which conforms to the inclined surface 26*a* of the detection rod 26. With this arrangement, downward movement of the detection rod 26 causes rightward movement of the shifting bar 7.

A roller 27 is rotatably mounted to the top end of the detection rod 26. The movable bar 9 is provided, at its lower side, with an inclined surface 9*a* inclined relative to its axis. The inclined surface 9*a* is so formed that it pushes down the roller 27 and the detection rod 26 when the movable contact 10 is advanced beyond the initial advanced position at which the movable contact 10 engages with the stationary contact 14 when there is no wear. The extent to which the detection rod 26 is pushed down is proportional to the additional displacement of the movable contact 10 beyond the initial advanced position.

To restrain the movement of the detection rod 26, or to brake the detection rod 26, thereby preventing unwanted slip of the detection rod 26, a spring 28 is fitted in a tubular opening 24*c* provided in the bearing block 24 to extend transversely to the axis of the detection rod 26. The spring 28 is compressed between a spring holder 30 fixed to the bearing block 24 and a lining 28 engaged with the detection rod 26, the lining 28 being thereby pressed against the detection rod 26.

Similarly, to brake the shifting bar 7, a spring 32 is fitted in a tubular opening 24*d* provided in the bearing block 24 to extend transversely to the axis of the shifting bar 7. The spring 32 is compressed between a spring holder 33 fixed to the bearing block 24 and a lining 31 in engagement with the shifting bar 7, the lining 31 being thereby pressed against the shifting bar 7.

As the output rod 2 is reciprocated upward and downward, the pin 6 extending through the slot 4 is moved and the bell crank 5 is pivoted about the pin 8 clockwise and counterclockwise, and accordingly the movable bar 9 is reciprocated rightward and leftward. When the movable bar 9 is moved rightward, the movable contact 10 is advanced and brought into contact with the stationary contact 14 so that the circuit breaker is closed. When the movable bar 9 is moved leftward, the movable contact 10 is retracted and separated from the stationary contact 14 so that the circuit breaker is opened. As the movable contact 10 is reciprocated, the bellows 22 is subject to stretch and contraction, i.e., variation in its length. When the movable contact 10 is at the advanced position, at which it is in contact with the stationary contact 14, the length of the bellows is maximum. When the movable contact 10 is at the retracted position, i.e., when its separation from the stationary contact 14 is maximum, the length of the bellows is minimum. The distance from the retracted position to the advanced position is the stroke of the movable contact 10. The distance from the initial retracted position to the advanced position is the displacement of the movable contact 10. The difference between the maximum length and the minimum length of the bellows is the amplitude of variation in length of the bellows. The amplitude of variation in length of the bellows coincides with the stroke of the movable contact 10.

When the vacuum circuit breaker is new and the movable and the stationary contacts are not worn, the displacement of the movable contact 10 coincides with the initial stroke $S_1$ determined in accordance with the required insulation strength and interrupting capacity. Accordingly, the movable bar 9 does not reach a point where the inclined surface 9*a* is in engagement with the roller 27.

Figure 1:
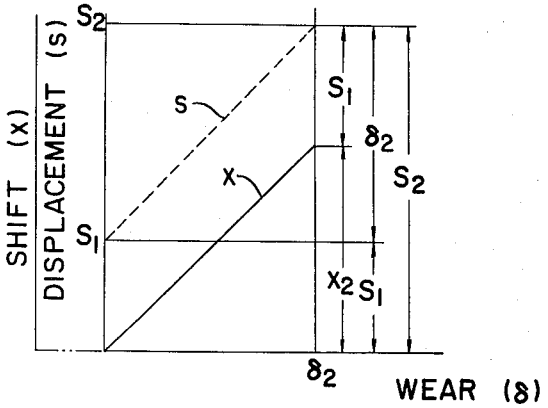
FIG. 1 is a graph showing the relationship between the total wear of the movable and the stationary contacts and the stroke of the movable contact.

As the opening and closing of the vacuum circuit breaker are repeated, the movable and the stationary contacts are worn out, so that the displacement of the movable contact is increased as shown by dashed line in FIG. 1. The maximum length of the bellows is concurrently increased. However, according to the invention, the stroke of the movable contact and the amplitude of variation in length of the bellows are maintained constant even when the contacts are worn out and the displacement of the movable contact and the maximum length of the bellows are increased. The reason is as follows:

As the contacts are worn out, and the displacement of the movable contact is increased, the movable bar 9, upon closure of the circuit breaker, reaches a position where the inclined surface 9*a* is in engagement with the roller 27 and the detection rod 26 is pushed down. The extent to which the detection rod 26 is lowered is proportional to the increase of the displacement of the movable contact and hence to the amount of wear of the contacts. As the detection rod 26 is lowered along the bore 24*b*, the inclined surface 26*a* pushes the inclined surface 25*a* rightward. Accordingly, the shifting bar 7 is shifted rightward, with the result that the pivot point 8 of the bell crank 5 is shifted rightward. The extent to which the shifting bar 7 is shifted rightward is proportional to the downward displacement of the detection rod 26, and can be made to coincide with the increase of the displacement of the movable contact, by properly determining the angles of inclinations of the inclined surfaces 9*a*, 25*a* and 26*a*. The slot 4 permits the pin 6 to be shifted with the pivot point 8.

If the pivot point 8 of the bell crank is shifted to the same extent as the increase of the maximum displacement of the movable contact, the retracted position of the movable contact is shifted rightward to the same extent as the shift of the pivot point 8. The extent of shift is shown as x in FIG. 2 and by a solid line x in FIG. 1.

Because of this shift x, the stroke of the movable contact and hence the amplitude of variation in length of the bellows are maintained constant.

It has been described that the inclined surface 9*a* of the drive bar 9 is so formed as to engage the roller 27 when the displacement of the movable contact 10 exceeds the initial displacement. However, the inclined surface 9*a* may be alternatively formed so that its engagement with the roller 27 is commenced when the displacement of the movable contact 10 exceeds a predetermined value greater than the initial displacement. In such a case, compensation for the wear is not made while the wear is relatively small.

It has also been described that the shifting bar 7 slides substantially horizontally. However, the directions of the movements may be altered. For instance, if the movable contact of the vacuum circuit breaker moves vertically, the shifting bar 7 is made to move vertically. In any case, the drive bar 9 extends and is slidable in a direction of movement of the movable contact, the shifting bar 7 is shifted along a line parallel to the axis of the drive bar 9 and toward the stationary contact 14, and the detection rod 26 is pushed by the inclined surface 9*a* away from the axis of the drive bar 9.

In place of the actuating device 1 shown in FIG. 2, any device capable of generating a motion when it is desired to open or close the vacuum circuit breaker may be used.

Figure 3:
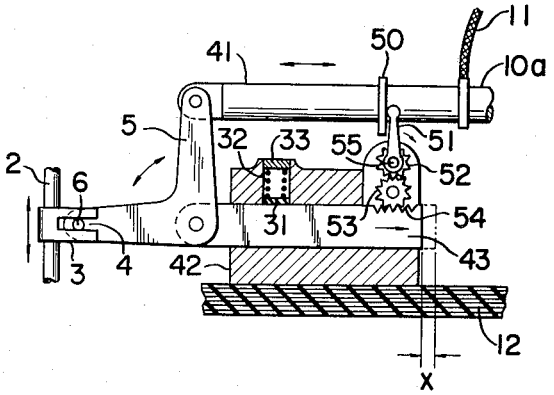
FIG. 3 is an elevational view, partly in section, showing a modification of parts of the driving mechanism illustrated in FIG. 2.

In the embodiment shown in FIG. 2, displacement of the movable contact 10 exceeding a predetermined value is detected by the detection rod 26 which is engaged and pushed by the inclined surface 9*a* of the drive bar 9. Such detection may be achieved in an alternative manner, as illustrated in FIG. 3. In FIG. 3, the drive bar 41 is provided with a projecting member in the form of a flange 50. A detection lever 51 is, at one end thereof, rotatably mounted to a bearing block 42. The other end of the detection lever 51 is engageable with and is adapted to be pushed by the flange 50 when the displacement of the movable contact exceeds a predetermined value.

A first pinion 52 is fixed to the detection lever 51 so that the first pinion 52 is rotatable with the detection lever 51. A second pinion 53 is rotatably mounted to the bearing block 42 and adapted to mesh with the first pinion 52. A shifting bar 43 is provided with a rack 54 engageable with the second pinion 53. As the detection lever 51 and hence the first pinion 52 are rotated, the second pinion is rotated in the reverse direction, and the shifting bar 43 with the rack 54 is moved along the axis of the shifting bar toward the stationary contact. The rest of the construction and operation of the arrangement shown in FIG. 3 are similar to those of the embodiment shown in FIG. 2.

Figure 4:
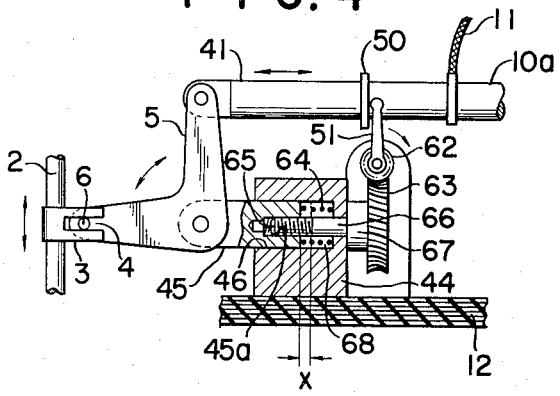
FIG. 4 is an elevational view, partly in section, showing a further modification of parts of the driving mechanism illustrated in FIG. 2.

FIG. 4 shows a further modification. This arrangement has a similar detection lever 51 rotatably mounted to a bearing block 44. A worm 62 is fixed to the detection lever 51 and is rotatable with the detection lever 51. A worm gear 63 is so oriented that its axis is parallel to the axis of the drive bar 41 and is adapted to mesh with the worm 62. A shaft 66 coaxial with and rotatable with the worm gear 63 is connected to the worm gear 63 by a larger diameter boss 67. The shaft 66 is rotatably supported by a bearing block 44. An end portion of the shaft 66 is provided with male screw threads 65 threaded into female screw threads 45*a* provided in a shifting bar 45. A hole 46 is provided in the bearing block 44 to receive the shifting bar 45. The shifting bar 45 is not inserted to the extremity of the hole 46 but a cavity 68 is formed between the end of the shifting bar 45 and the extremity of the hole 46, in which cavity a spring 64 is placed. The spring serves to exert force on the shifting bar 45 for biasing it leftward, so that rightward displacement of the worm gear 63 is prevented. Leftward displacement of the worm gear 63 is prevented by the boss 67 engaging the bearing block. As the lever 51 and the worm 62 are rotated, the worm gear 63 and hence the male screw threads 65 are rotated, Accordingly, the shifting bar 46 is shifted leftward. The rest of the construction and operation are similar to those of FIG. 2.

What is claimed is:

1. In a driving mechanism for a vacuum circuit breaker of the type wherein a movable contact is moved toward and away from a stationary contact, the driving mechanism having actuating means for opening and closing the vacuum circuit breaker, and a bell crank rotatable about a pivot pin and interposed between said actuating means and the movable contact, the improvement which comprises shifting means for shifting, in accordance with the wear of the movable and the stationary contacts, the pivot pin of said bell crank in parallel with the axis of the movable contact to correct the retracted position of the movable contact, to compensate for the wear of the movable and the stationary contacts.

2. A driving mechanism as set forth in claim 1, further comprising detecting means adapted to move when displacement of the movable contact exceeds a predetermined value, wherein said shifting means responds to the motion of said detecting means.

3. A driving mechanism as set forth in claim 2, wherein said shifting means comprises a shifting bar slidable in a direction substantially parallel to the axis of the movable contact, and said bell crank is pivotally mounted to said shifting bar.

4. A driving mechanism as set forth in claim 3, further comprising motion converting means for converting the motion of said detecting means into sliding motion of said shifting bar for shifting the pivot pin of said bell crank.

5. A driving mechanism as set forth in claim 4, further comprising a drive bar which is provided with an inclined surface inclined relative to the axis of said drive bar, and said detecting means comprises a detection rod extending and slidable in a direction transverse to the axis of said drive bar and adapted to be pushed by said inclined surface of said drive bar away from the axis of said drive bar when the displacement of the movable contact exceeds the predetermined value, said detection rod havng an inclined surface inclined relative to the axis of said detection rod, and wherein said shifting bar has an inclined surface conforming to said inclined surface of said detection rod, said inclined surface of said detection rod and said inclined surface of said shifting bar being so formed that as said direction rod is moved away from the axis of said drive bar said shifting bar is moved along its axis toward said stationary contact.

6. A driving mechanism as set forth in claim 5, further comprising a bearing block for supporting said detection rod to be slidable along the axis of said detection rod and for supporting said shifting bar to be slidable along the axis of said shifting bar.

7. A driving mechanism as set forth in claim 6, further comprising a first braking means for braking said detection rod to prevent unwanted displacement of said detection rod, and a second braking means for braking said shifting bar to prevent unwanted displacement of said shifting bar.

8. A driving mechansim as set forth in claim 4, further comprising a drive bar which is provided with a projecting member, wherein said detecting means comprises a lever rotatable about one end thereof and having the other end adapted to be engageable with and pushed by said projecting member of said drive bar when the displacement of the movable contact exceeds the predetermined value.

9. A driving mechanism as set forth in claim 8, wherein said converting means comprises a first pinion rotatable with said lever and a second pinion meshing with said first pinion, and said shifting bar is provided with a rack engageable with said second pinion, whereby the rotation of said lever and said first pinion leads to rotation of said second pinion, which causes axial sliding movement of said shifting bar toward said stationary contact.

10. A driving mechanism as set forth in claim 9, further comprising a bearing block for supporting said shifting bar slidably along its axis.

11. A driving mechanism as set forth in claim 10, further comprising means for braking said shifting bar to prevent unwanted displacement of said shifting bar.

12. A driving mechanism as set forth in claim 8, wherein said converting means comprises a worm rotatable with said lever and a worm gear meshing with said worm, said shifting bar is connected with said worm gear through screw threads, whereby as said detection lever and said worm are rotated, said shifting bar is shifted toward said stationary contact.

* * * * *